US005891005A

United States Patent [19]

Drukarov

[11] Patent Number: 5,891,005

[45] Date of Patent: Apr. 6, 1999

[54] HEAD AND NECK SUPPORT FOR ABDOMINAL EXERCISE

[76] Inventor: Henry Drukarov, 6 Hazelwood Ave., Livingston, N.J. 07039

[21] Appl. No.: 10,761

[22] Filed: Jan. 22, 1998

[51] Int. Cl.[6] ..... A63B 23/02

[52] U.S. Cl. ..... 482/140; 482/131; 482/139

[58] Field of Search ..... 482/10, 91, 121–123, 482/131, 132, 133, 139, 140, 148, 907, 908; 601/39; 128/845, 869, 870; D21/686–688; D24/190, 191

[56] References Cited

U.S. PATENT DOCUMENTS

| | | | |
|---|---|---|---|
| 4,561,649 | 12/1985 | Forsythe | 482/131 |
| 4,688,793 | 8/1987 | Syrek, III | 482/139 |
| 5,122,107 | 6/1992 | Gardner | 482/140 |
| 5,759,138 | 6/1998 | Boland | 482/122 |
| 5,772,562 | 6/1998 | Stevens | 482/132 |
| 5,776,042 | 7/1998 | Szabo | 482/142 |

*Primary Examiner*—Jeanne M. Clark

[57] ABSTRACT

A new head and neck support for abdominal exercise for properly supporting a user's head and neck while performing crunches. The inventive device includes a base member having an elongated stem pivotally coupled to and extending upwardly therefrom. The stem has a notch formed within a free end thereof. An upper member has a forward edge hingedly coupled with a forward edge of the base member. The upper member has a plurality of apertures therethrough for selectively engaging the notch in the elongated stem to fix an angle of the upper member with respect to the base member. The upper member has an open rearward edge. A handle portion is adjustably received within the open rearward edge of the upper member. An adjustable strap is secured to a rearward edge of the base member. The adjustable strap has branched outer ends. A head harness is secured between the branched outer ends of the adjustable strap.

7 Claims, 2 Drawing Sheets

HEAD AND NECK SUPPORT FOR ABDOMINAL EXERCISE

BACKGROUND OF THE INVENTION

1. Field of the Invention

The present invention relates to exercise devices and more particularly pertains to a new head and neck support for abdominal exercise for properly supporting a user's head and neck while performing crunches.

2. Description of the Prior Art

The use of exercise devices is known in the prior art. More specifically, exercise devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art exercise devices include U.S. Pat. No. 4,832,336 to Lahman; U.S. Pat. No. 4,838,547 to Sterling; U.S. Pat. No. Des. 277,219 to Johnson; U.S. Pat. No. 5,190,513 to Habing et al.; U.S. Pat. No. 4,240,626 to Lambert, Jr.; and U.S. Pat. No. 4,662,631 to Seal.

While these devices fulfill their respective, particular objectives and requirements, the aforementioned patents do not disclose a new head and neck support for abdominal exercise. The inventive device includes a base member having an elongated stem pivotally coupled to and extending upwardly therefrom. The stem has a notch formed within a free end thereof. An upper member has a forward edge hingedly coupled with a forward edge of the base member. The upper member has a plurality of apertures therethrough for selectively engaging the notch in the elongated stem to fix an angle of the upper member with respect to the base member. The upper member has an open rearward edge. A handle portion is adjustably received within the open rearward edge of the upper member. An adjustable strap is secured to a rearward edge of the base member. The adjustable strap has branched outer ends. A head harness is secured between the branched outer ends of the adjustable strap.

In these respects, the head and neck support for abdominal exercise according to the present invention substantially departs from the conventional concepts and designs of the prior art, and in so doing provides an apparatus primarily developed for the purpose of properly supporting a user's head and neck while performing crunches.

SUMMARY OF THE INVENTION

In view of the foregoing disadvantages inherent in the known types of exercise devices now present in the prior art, the present invention provides a new head and neck support for abdominal exercise construction wherein the same can be utilized for properly supporting a user's head and neck while performing crunches.

The general purpose of the present invention, which will be described subsequently in greater detail, is to provide a new head and neck support for abdominal exercise apparatus and method which has many of the advantages of the exercise devices mentioned heretofore and many novel features that result in a new head and neck support for abdominal exercise which is not anticipated, rendered obvious, suggested, or even implied by any of the prior art exercise devices, either alone or in any combination thereof.

To attain this, the present invention generally comprises a base member having a generally rectangular configuration. The base member has a cylindrical member secured to a forward edge thereof. The base member has an elongated stem pivotally coupled to and extending upwardly therefrom. The stem has a notch formed within a free end thereof. An upper member is provided having a generally rectangular configuration. The upper member has a forward edge hingedly coupled with the forward edge of the base member. The upper member has a plurality of apertures therethrough for selectively engaging the notch in the elongated stem to fix an angle of the upper member with respect to the base member. The upper member has an open rearward edge with an adjustment pin extending inwardly thereof. A handle portion is adjustably received within the open rearward edge of the upper member. The handle portion has a lower member telescopically received within the open rearward edge. The lower member has a plurality of indentations therein for selectively receiving the adjustment pin therein. An upper free end of the lower member has a cross-bar secured thereto in an orthogonal relationship. An adjustable strap is secured to a rearward edge of the base member. The adjustable strap has branched outer ends. A head harness is secured between the branched outer ends of the adjustable strap. The head harness has a pair of side straps secured between the branched outer ends. The pair of side straps have a plurality of cylindrical foam pads extending therebetween for supporting a head of a user thereon.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new head and neck support for abdominal exercise apparatus and method which has many of the advantages of the exercise devices mentioned heretofore and many novel features that result in a new head and neck support for abdominal exercise which is not anticipated, rendered obvious, suggested, or even implied by any of the prior art exercise devices, either alone or in any combination thereof.

It is another object of the present invention to provide a new head and neck support for abdominal exercise which may be easily and efficiently manufactured and marketed.

It is a further object of the present invention to provide a new head and neck support for abdominal exercise which is of a durable and reliable construction.

An even further object of the present invention is to provide a new head and neck support for abdominal exercise which is susceptible of a low cost of manufacture with regard to both materials and labor, and which accordingly is then susceptible of low prices of sale to the consuming public, thereby making such head and neck support for abdominal exercise economically available to the buying public.

Still yet another object of the present invention is to provide a new head and neck support for abdominal exercise which provides in the apparatuses and methods of the prior art some of the advantages thereof, while simultaneously overcoming some of the disadvantages normally associated therewith.

Still another object of the present invention is to provide a new head and neck support for abdominal exercise for properly supporting a user's head and neck while performing crunches.

Yet another object of the present invention is to provide a new head and neck support for abdominal exercise which includes a base member having an elongated stem pivotally coupled to and extending upwardly therefrom. The stem has a notch formed within a free end thereof. An upper member has a forward edge hingedly coupled with a forward edge of the base member. The upper member has a plurality of apertures therethrough for selectively engaging the notch in the elongated stem to fix an angle of the upper member with respect to the base member. The upper member has an open rearward edge. A handle portion is adjustably received within the open rearward edge of the upper member. An adjustable strap is secured to a rearward edge of the base member. The adjustable strap has branched outer ends. A head harness is secured between the branched outer ends of the adjustable strap.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
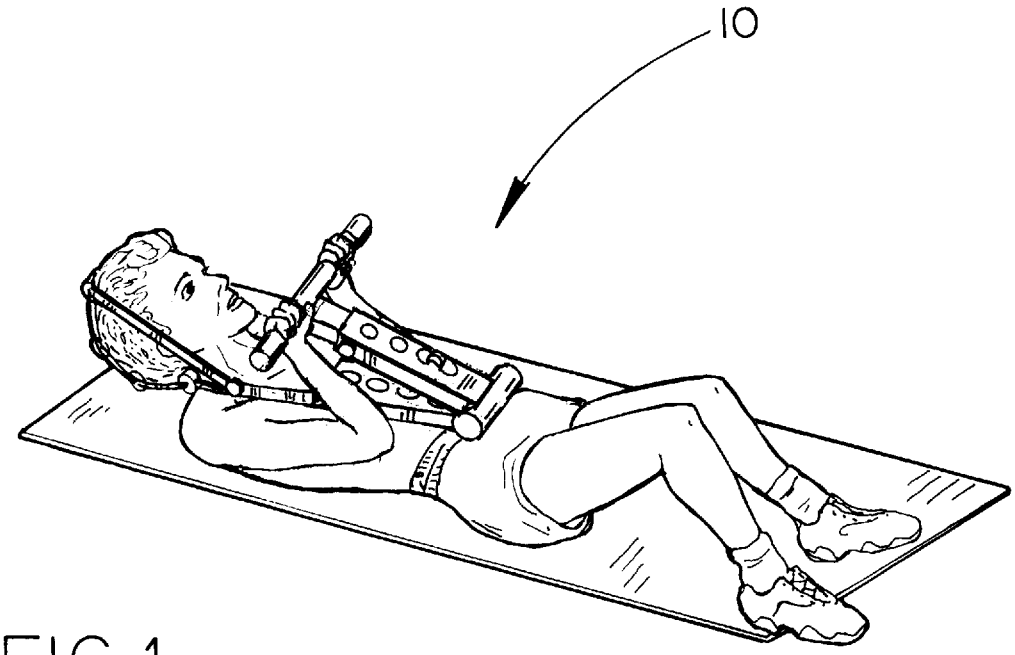
FIG. 1 is a perspective view of a new head and neck support for abdominal exercise according to the present invention illustrated in use.
Figure 4:
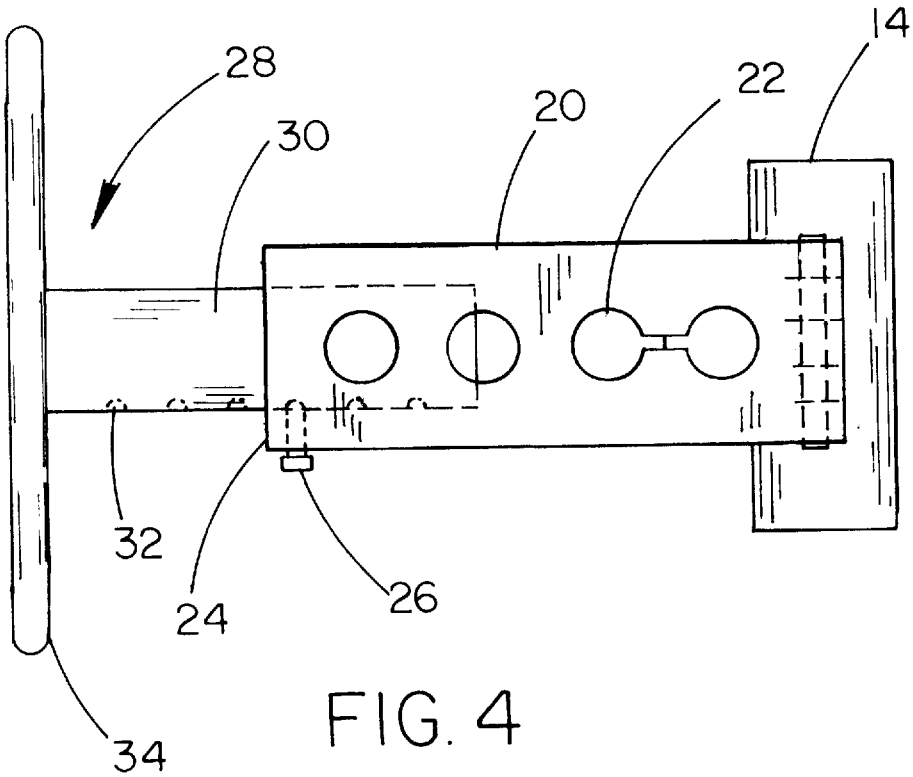
FIG. 4 is a plan view of the present invention illustrating a top portion thereof as taken along line 4—4 of FIG. 2.
Figure 2:
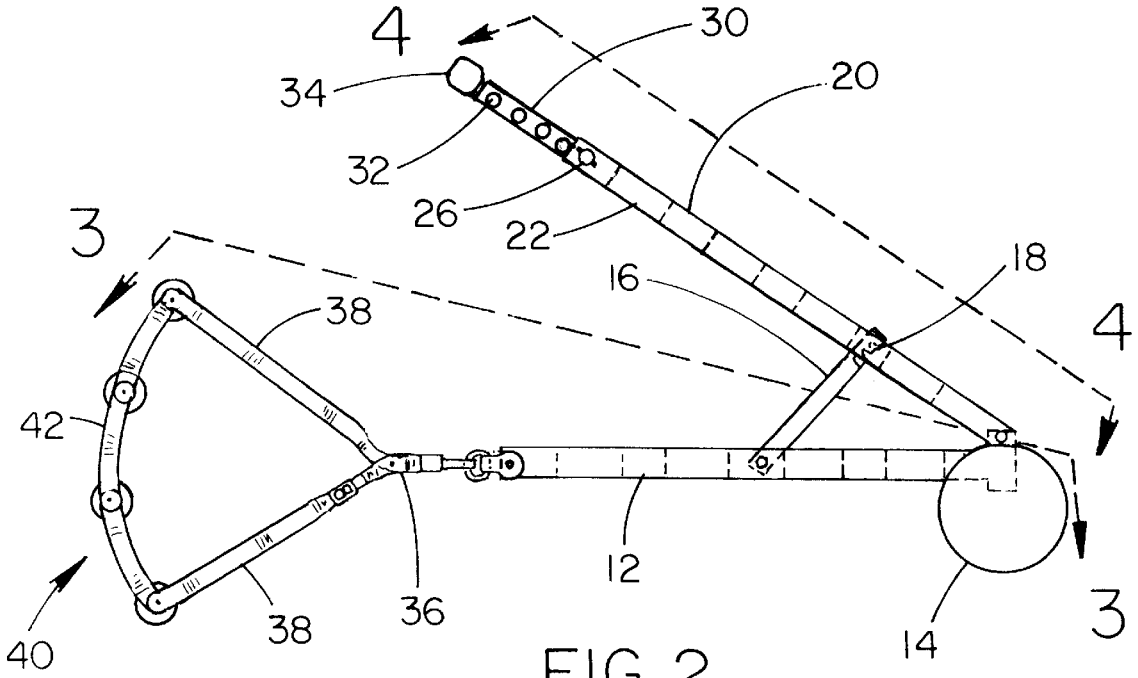
FIG. 2 is a side elevation view of the present invention.
Figure 3:
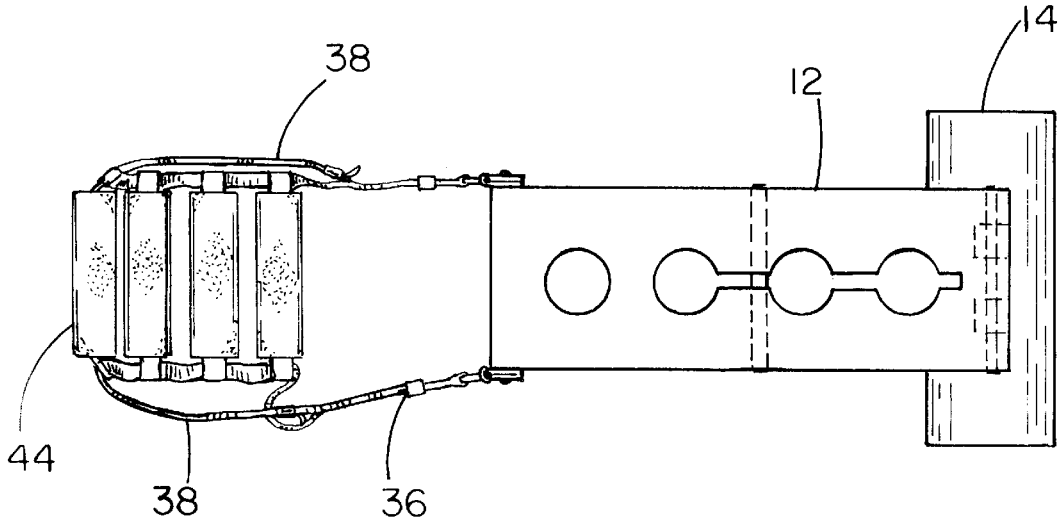
FIG. 3 is a cross-sectional view of the present invention as taken along line 3—3 of FIG. 2.

With reference now to the drawings, and in particular to FIGS. 1 through 4 thereof, a new head and neck support for abdominal exercise embodying the principles and concepts of the present invention and generally designated by the reference numeral 10 will be described.

As best illustrated in FIGS. 1 through 4, the head and neck support for abdominal exercise 10 comprises a base member 12 having a generally rectangular configuration. The base member 12 has a cylindrical member 14 secured to a forward edge thereof. The base member 12 has an elongated stem 16 pivotally coupled to and extending upwardly therefrom. The stem 16 has a notch 18 formed within a free end thereof.

An upper member 20 is provided having a generally rectangular configuration. The upper member 20 has a forward edge hingedly coupled with the forward edge of the base member 12. The upper member 20 has a plurality of apertures 22 therethrough for selectively engaging the notch 18 in the elongated stem 16 to fix an angle of the upper member 20 with respect to the base member 12. The upper member 20 has an open rearward edge 24 with an adjustment pin 26 extending inwardly thereof.

A handle portion 28 is adjustably received within the open rearward edge 26 of the upper member 20. The handle portion 28 has a lower member 30 telescopically received within the open rearward edge 26. The lower member 30 has a plurality of indentations 32 therein for selectively receiving the adjustment pin 26 therein. An upper free end of the lower member 30 has a cross-bar 34 secured thereto in an orthogonal relationship.

An adjustable strap 36 is secured to a rearward edge of the base member 12. The adjustable strap 36 has branched outer ends 38.

A head harness 40 is secured between the branched outer ends 38 of the adjustable strap 36. The head harness 40 has a pair of side straps 42 secured between the branched outer ends 38. The pair of side straps 42 have a plurality of cylindrical foam pads 44 extending therebetween for supporting a head of a user thereon.

In use, an exercise enthusiast would lie down on the floor, place the head harness 40 around his head, and rest the base member 12 on his chest with the cylindrical member 14 abutting his abdominal muscles so that the handle portion 28 is elevated above his chest. The user holds onto the cross-bar 34 when performing a set of abdominal crunches. As the user lifts his upper body, the head harness 40 would support his head and neck.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A new head and neck support for abdominal exercise for properly supporting a user's head and neck while performing crunches comprising, in combination:

a base member having a generally rectangular configuration, the base member having a cylindrical member secured to a forward edge thereof, the base member having an elongated stem pivotally coupled to and extending upwardly therefrom, the stem having a notch formed within a free end thereof;

an upper member having a generally rectangular configuration, the upper member having a forward edge hingedly coupled with the forward edge of the base member, the upper member having a plurality of apertures therethrough for selectively engaging the notch in the elongated stem to fix an angle of the upper member with respect to the base member, the upper member having an open rearward edge with an adjustment pin extending inwardly thereof;

a handle portion adjustably received within the open rearward edge of the upper member, the handle portion having a lower member telescopically received within the open rearward edge, the lower member having a plurality of indentations therein for selectively receiving the adjustment pin therein, an upper free end of the lower member having a cross-bar secured thereto in an orthogonal relationship;

an adjustable strap secured to a rearward edge of the base member, the adjustable strap having branched outer ends;

a head harness secured between the branched outer ends of the adjustable strap, the head harness having a pair of side straps secured between the branched outer ends, the pair of side straps having a plurality of cylindrical foam pads extending therebetween for supporting a head of a user thereon.

2. A new head and neck support for abdominal exercise for properly supporting a user's head and neck while performing crunches comprising, in combination:

a base member having an elongated stem pivotally coupled to and extending upwardly therefrom, the stem having a notch formed within a free end thereof;

an upper member having a forward edge hingedly coupled with a forward edge of the base member, the upper member having a plurality of apertures therethrough for selectively engaging the notch in the elongated stem to fix an angle of the upper member with respect to the base member, the upper member having an open rearward edge;

a handle portion adjustably received within the open rearward edge of the upper member;

an adjustable strap secured to a rearward edge of the base member, the adjustable strap having branched outer ends;

a head harness secured between the branched outer ends of the adjustable strap.

3. The head and neck support for abdominal exercise as set forth in claim 2 wherein the open rearward edge of the upper member has an adjustment pin extending inwardly thereof for engaging the handle portion.

4. The head and neck support for abdominal exercise as set forth in claim 3 wherein the handle portion has a lower member telescopically received within the open rearward edge, the lower member having a plurality of indentations therein for selectively receiving the adjustment pin therein.

5. The head and neck support for abdominal exercise as set forth in claim 4 wherein an upper free end of the lower member has a cross-bar secured thereto in an orthogonal relationship.

6. The head and neck support for abdominal exercise as set forth in claim 2 wherein the head harness has a pair of side straps secured between the branched outer ends, the pair of side straps having a plurality of cylindrical foam pads extending therebetween for supporting a head of a user thereon.

7. The head and neck support for abdominal exercise as set forth in claim 2 wherein the base member has a cylindrical member secured to a forward edge thereof.

* * * * *